US008708061B2

(12) United States Patent
Nickels et al.

(10) Patent No.: US 8,708,061 B2
(45) Date of Patent: Apr. 29, 2014

(54) LOWER DAMPER FOR DEMOLITION HAMMER

(75) Inventors: James G. Nickels, McGregor, TX (US); Tommie L Craven, Belton, TX (US)

(73) Assignee: Caterpillar Inc., Peoria, IL (US)

( * ) Notice: Subject to any disclaimer, the term of this patent is extended or adjusted under 35 U.S.C. 154(b) by 522 days.

(21) Appl. No.: 12/967,130

(22) Filed: Dec. 14, 2010

(65) Prior Publication Data

US 2012/0145426 A1 Jun. 14, 2012

(51) Int. Cl.
*B25D 17/24* (2006.01)

(52) U.S. Cl.
USPC ..... 173/211; 173/128; 173/162.1

(58) Field of Classification Search
USPC ..... 173/128, 210, 211, 162, 1, 162.2, 133, 173/135; 299/37.4, 100
See application file for complete search history.

(56) References Cited

U.S. PATENT DOCUMENTS

| | | | | | |
|---|---|---|---|---|---|
| 2,058,583 | A | * | 10/1936 | Forss | 173/162.2 |
| 2,094,184 | A | * | 9/1937 | Noble | 173/99 |
| 3,003,773 | A | | 10/1961 | Fuehrer | |
| 3,757,875 | A | * | 9/1973 | Gunning | 173/44 |
| 3,968,843 | A | * | 7/1976 | Shotwell | 173/210 |
| 4,215,901 | A | * | 8/1980 | Langfield et al. | 299/22 |
| 4,609,135 | A | | 9/1986 | Elliesen | |
| 4,886,128 | A | | 12/1989 | Roemer | |
| 5,285,858 | A | * | 2/1994 | Okada et al. | 173/211 |
| 5,419,404 | A | * | 5/1995 | Niemi et al. | 173/171 |
| 5,431,235 | A | * | 7/1995 | Drumheller et al. | 173/211 |
| 5,878,823 | A | * | 3/1999 | Henriksson | 173/132 |
| 6,095,257 | A | * | 8/2000 | Lee | 173/211 |
| 6,098,723 | A | | 8/2000 | Yaniero et al. | |
| 6,227,307 | B1 | * | 5/2001 | Lee | 173/78 |
| 6,328,116 | B1 | | 12/2001 | Hurskainen et al. | |
| 6,561,285 | B2 | * | 5/2003 | Intonen et al. | 173/211 |
| 7,401,661 | B2 | * | 7/2008 | Berghauser et al. | 173/210 |
| 7,413,028 | B2 | * | 8/2008 | Comarmond | 173/132 |
| 7,523,997 | B2 | * | 4/2009 | Jalabert et al. | 299/100 |
| 7,614,460 | B2 | * | 11/2009 | Henriksson et al. | 173/109 |
| 7,628,222 | B2 | * | 12/2009 | Yoshimura et al. | 173/162.1 |
| 7,832,495 | B2 | * | 11/2010 | Pillers, II | 173/1 |
| D645,480 | S | * | 9/2011 | Pillers et al. | D15/28 |
| 8,061,439 | B2 | * | 11/2011 | Nelson | 173/210 |
| 8,360,167 | B2 | * | 1/2013 | Jagdale et al. | 173/90 |
| 2005/0269117 | A1 | | 12/2005 | Sato et al. | |
| 2008/0066938 | A1 | | 3/2008 | Webber | |

(Continued)

FOREIGN PATENT DOCUMENTS

| | | |
|---|---|---|
| EP | 1005960 | 6/2000 |
| EP | 2105260 | 9/2009 |

(Continued)

*Primary Examiner* — Scott A. Smith
(74) *Attorney, Agent, or Firm* — Mark Hull

(57) ABSTRACT

A demolition hammer is provided that may include a housing having a distal end, a power cell disposed in the housing, an end plate attached to the distal end of the housing, and a damper disposed in the housing between the power cell and the end plate, wherein the damper is spaced apart from the power cell by a gap. The damper may also support and align a plurality of wear plates interposed between the housing and power cell. The damper may have generally rectangular first portion having a planar upper surface and a planar lower surface generally parallel to the upper surface and a generally circular second portion extending from the lower surface, wherein the first portion and the section portion define a central through bore.

7 Claims, 4 Drawing Sheets

(56) References Cited

U.S. PATENT DOCUMENTS

| | | | |
|---|---|---|---|
| 2008/0296035 | A1 | 12/2008 | Lohmann et al. |
| 2009/0096275 | A1 | 4/2009 | Nelson |
| 2009/0194336 | A1 | 8/2009 | Larsson et al. |

FOREIGN PATENT DOCUMENTS

| | | |
|---|---|---|
| JP | 2005001063 | 1/2005 |
| JP | 2007118124 | 5/2007 |
| WO | 2008069685 | 6/2008 |

* cited by examiner

LOWER DAMPER FOR DEMOLITION HAMMER

TECHNICAL FIELD

This disclosure relates generally to demolition hammers, and more specifically to a lower damper for a demolition hammer.

BACKGROUND

Demolition hammers are used on work sites to break up hard objects such as rocks, concrete, asphalt, frozen ground, or other materials. The hammers may be mounted to machines, such as back hoes and excavators, or may be hand-held. Such hammers may include a pneumatically or hydraulically actuated power cell having an impact system operatively coupled to a tool. The impact system generates repeated, longitudinally directed forces against a proximal end of a tool disposed inside the hammer housing. The tool extends from the housing to engage the hard object. The forces against a proximal end of a tool are transmitted through the tool to the hard object.

During operation of the hammer, a blank fire may occur. A blank fire refers to when the tool reaches the end of its power stroke without engaging the hard object. When this occurs, the tool abuts a stop and the forces intended to be used to break up the hard object, must be absorbed by the hammer. Buffers used to support the power cell in the housing may absorb some of the forces, while other structural components, such as tie rods, absorb the brunt of the load. Overstressing the tie rods can lead to rod failure, which can cause serious damage to the impact system, including the piston, and other hammer components.

SUMMARY OF THE DISCLOSURE

According to certain aspects of this disclosure, a demolition hammer may include a housing having a distal end, a power cell disposed in the housing, an end plate attached to the distal end of the housing, and a damper disposed in the housing between the power cell and the end plate, wherein the buffer is spaced apart from the power cell by a gap. In one embodiment, the hammer may include a plurality of wear plates interposed between the housing and power cell and the damper may support and align the plurality of wear plates within the housing.

In another aspect of the disclosure, a damper for a demolition hammer is provided, having a generally rectangular first portion having a planar upper surface and a planar lower surface generally parallel to the upper surface and a generally circular second portion extending from the lower surface, wherein the first portion and the section portion define a central through bore.

DETAILED DESCRIPTION

Figure 1:
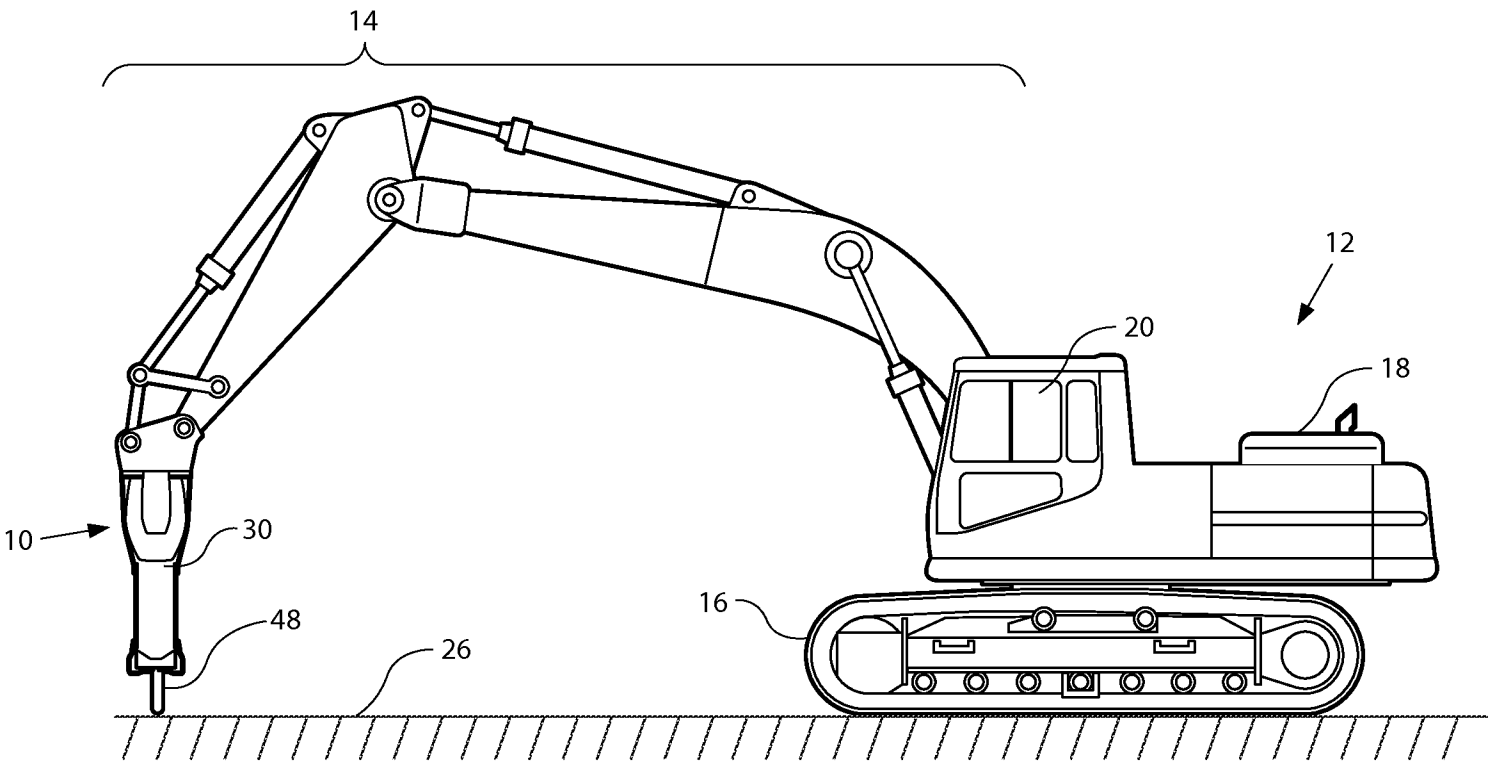
FIG. 1 is a diagrammatic illustration of a machine having a demolition hammer.

Referring to FIG. 1, a demolition hammer 10 is attached to a machine 12. Machine 12 may embody a fixed or mobile machine that performs some type of operation associated with an industry such as mining, construction, farming, transportation, or any other industry known in the art. For example, machine 12 may be an earth moving machine such as a backhoe, an excavator, a dozer, a loader, a motor grader, or any other earth moving machine. Machine 12 may include an implement system 14 configured to move the demolition hammer 10, a drive system 16 for propelling the machine 12, a power source 18 that provides power to implement system 14 and drive system 16, and an operator station 20 for operator control of implement system 14 and drive system 16.

Power source 18 may embody an engine such as, for example, a diesel engine, a gasoline engine, a gaseous fuel-powered engine or any other type of combustion engine known in the art. It is contemplated that power source 18 may alternatively embody a non-combustion source of power such as a fuel cell, a power storage device, or another source known in the art. Power source 18 may produce a mechanical or electrical power output that may then be converted to hydraulic pneumatic power for moving the implement system 14.

Implement system 14 may include a linkage structure acted on by fluid actuators to move the hammer 10. The linkage structure of implement system 14 may be complex, for example, including three or more degrees of freedom. The implement system 14 may carry the hammer 10 for breaking an object or ground surface 26.

The structure and operation of a demolition hammer are briefly described below. Demolition hammers are known in the art, and since it will be apparent to one skilled in the art that various aspects of the disclosed the housing and wear plates may be used with a variety of demolition hammers, a detailed description of all the components and operation of a demolition hammer is not provided.

Figure 2:
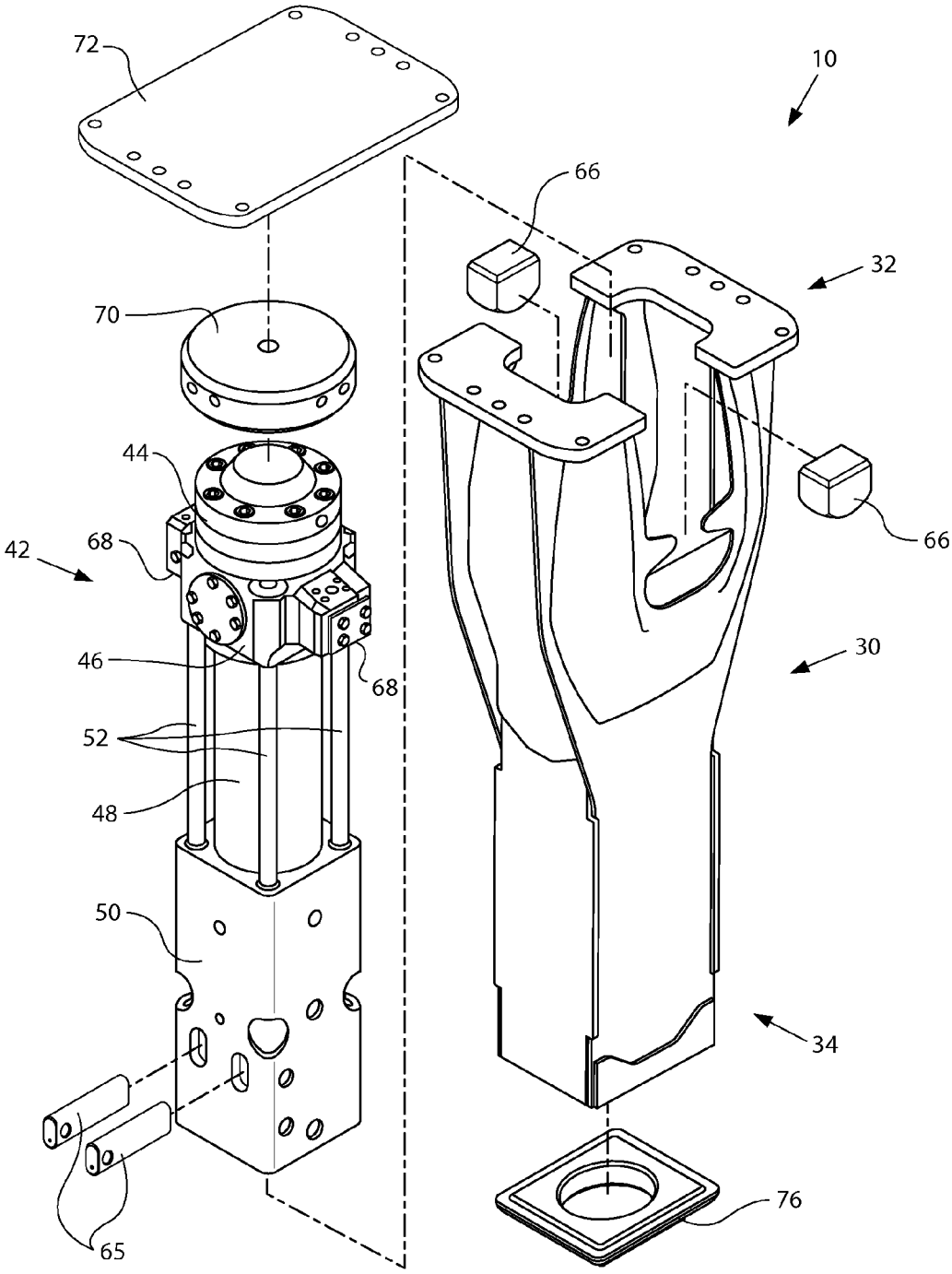
FIG. 2 is a partial exploded view of a demolition hammer assembly.
Figure 3:
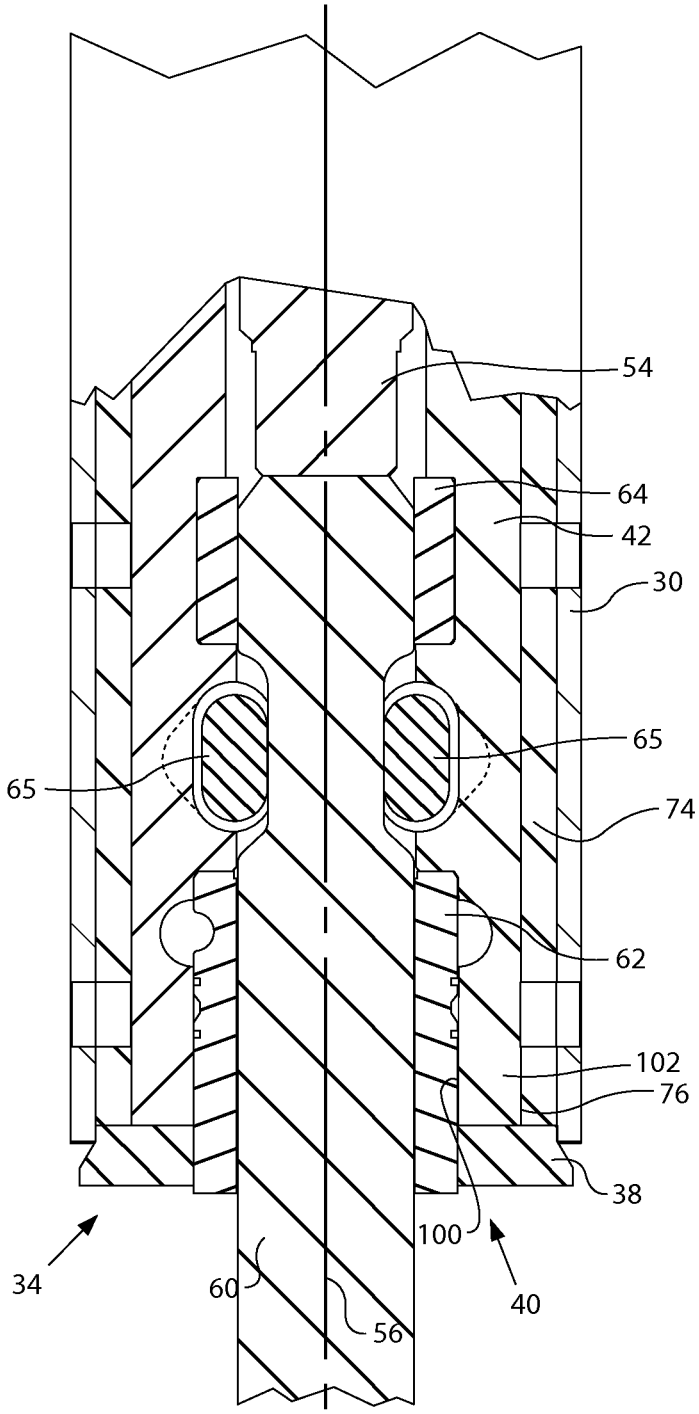
FIG. 3 is partial cross-sectional view of the distal end of the hammer of FIG. 2.

Referring to FIGS. 2 and 3, the exemplary hammer 10 includes a hollow housing 30 having a proximal end 32 and a distal end 34. An end plate 38 (FIG. 3), defining an opening 40, is attached to the distal end 34 of the housing 30. A power cell 42 is disposed inside the housing 30. The power cell 42 includes several internal components of the hammer 10. In the depicted embodiment, the power cell 42 includes an accumulator assembly 44, a valve assembly 46, an impact system 48, and a front head 50. The accumulator assembly 44 is mounted to the valve assembly 46. Tie rods 52 are used to hold the hammer 10 together by sandwiching the impact system 48 between the front head 50 and the accumulator assembly/valve assembly 44/46. The impact system 48 includes a piston 54 (FIG. 3) that extends into the front head 50. The piston 54 is operatively positioned within the power cell 42 to move along an axis 56. A distal portion of the power cell 42 includes a tool 60 that is operatively positioned to move along the axis 56. A lower bushing 62 and an upper bushing 64 are positioned in the power cell 42 for guiding the tool 60 during operation of the hammer 10.

The tool 60 is retained within the power cell 42 by a pair of tool retention pins 65. The tool retention pins 65 allow the tool 60 to move axially, but limit how far the tool may extend or retract by acting as a stop. Thus, the tool 60 will contact the tool retention pins 65 if the tool reaches the end of its work stroke.

The hammer 10 may be powered by any suitable means, such as pneumatically-powered or hydraulically-powered. For example, a hydraulic or pneumatic circuit (not shown) may provide pressurized fluid to drive the piston 54 toward the tool 60 during a work stroke and to return the piston 54 during a return stroke. The hydraulic or pneumatic circuit is not described further, since it will be apparent to one skilled in the art that any suitable hydraulic or pneumatic systems may be used to provide pressurized fluid to the piston 54, such as the hydraulic arrangement described in U.S. Pat. No. 5,944,120.

In operation, the piston 54 is driven into the proximal end of the tool 60. The distal end of the tool 60 is positioned to engage an object or ground surface 26 (FIG. 1). The impact of the piston 54 on the tool 60 may cause a shock wave that fractures the hard object (e.g. rock) causing it to break apart.

The power cell 42 is supported inside the housing 30 by a pair of side buffers 66. In the depicted embodiment, the pair of side buffers 66 that are mounted on opposite sides of the housing 30. The power cell 42 includes shoulder surfaces 68 (or projections) that engage the side buffers 66 such that the weight of the power cell 42 is supported by the side buffers 66. A top buffer 70 is positioned onto of the accumulator assembly 44 and a top plate 72 is bolted onto the proximal end 32 of the housing 30. Thus, the power cell 42 is sandwiched between the side buffers 66 (which engage the shoulders surfaces 68) and the top plate 72 and top buffer 70 (which engage the accumulator assembly 44).

The side buffers 66 are constructed of a stiff material capable of supporting the power cell within the housing but with some elasticity to dampen downward forces from the piston and tool. As a result, the power cell 42 has some axial movement relative to the housing 30. A plurality of wear plates 74 are interposed between the power cell 42 and the housing 30 and absorb the wear from the relative movement of the power cell relative to the housing.

Figure 4:
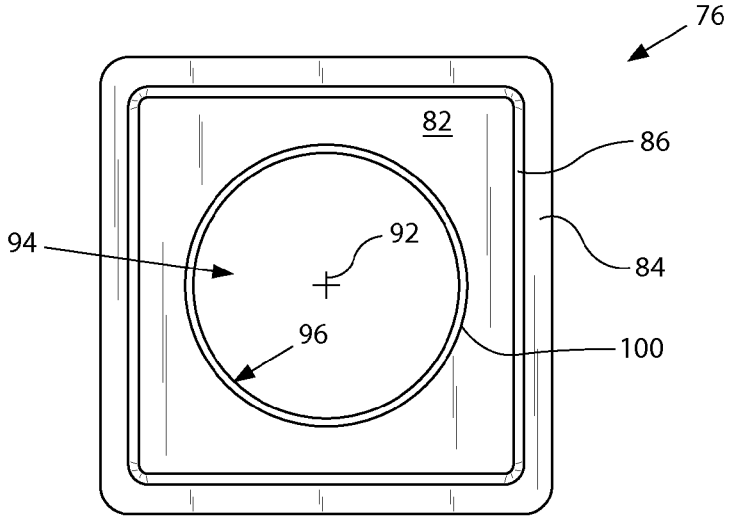
FIG. 4 is top view of an embodiment of a lower damper of the hammer of FIG. 2.
Figure 5:
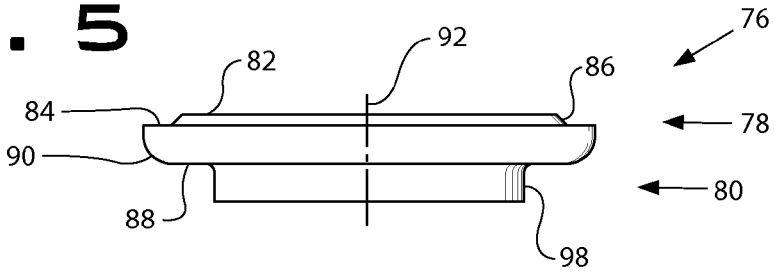
FIG. 5 is a side view of the lower damper of FIG. 4.
Figure 6:
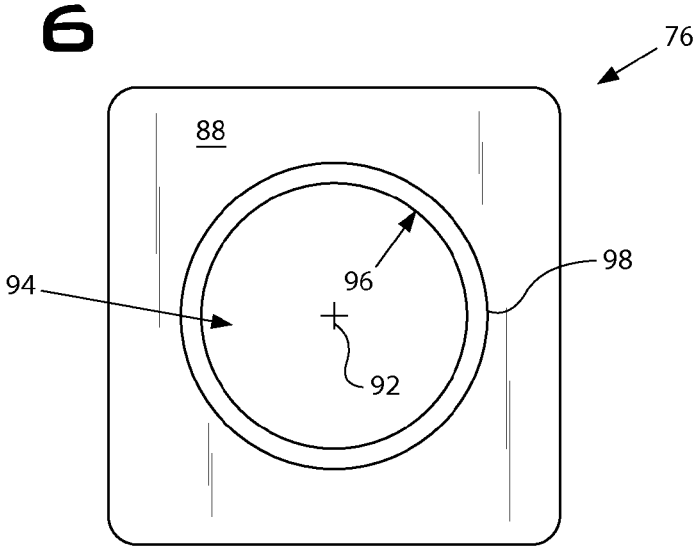
FIG. 6 is a bottom view of the lower damper of FIG. 4.

The hammer 10 also includes a lower damper 76 positioned between the power cell 42 and the end plate 38. Referring to FIGS. 4-6, the depicted embodiment of the lower damper 76 includes a generally rectangular first portion 78 and a generally circular second portion 80. The first portion 78 has an upper surface having a generally planar inner face 82 connected to a generally planar outer face 84 by an intermediate angled surface 86. The first portion 78 includes a lower surface 88 generally parallel to the inner face 82 and a rounded lower edge 90 adjacent the lower surface 88.

The second portion 80 extends from the lower surface 88 along a central axis 92. The first portion 78 and the second portion 80 define a central through bore 94 having a cylindrical inner surface 96. The second portion 80 includes a cylindrical outer surface 98 generally parallel with the cylindrical inner surface 96 to for a cylindrical side wall. The lower damper 76 may include a chamfered edge 100 circumscribing the through bore 94 at the inner face 82.

Referring to FIG. 3, in an assembled hammer, the lower damper 76 is positioned in the distal end 34 of the housing 30 between the end plate 38 and the power cell 42. In particular, the lower surface 88 is supported on the end plate 38 and the second portion 80 is received in the end plate opening 40. The lower bushing 62 and the tool 60 extend through the through bore 94 in the lower damper 76. The wear plates 74 are supported within the housing 30 by the outer face 84 of the lower damper 76. The intermediate angled surface 86 keeps the lower end of the wear plates 74 positioned outward against the inner wall of the housing 30.

Unlike the side buffers 66, the lower damper 76 does not support the weight of the power cell 42 within the housing 30. The lower damper 76 is positioned such that the inner face 82 is axially below and spaced apart from the power cell 42 by a gap 102. Lower damper 76 may be formed from a variety of suitable materials. A suitable material for the lower damper 76 should provide a cushioning effect for when the front head 50 contacts the lower damper when extreme downward forces are seen from the piston 54 and tool 60. In the depicted embodiment, the lower damper 76 is formed from a urethane material.

A person of ordinary skill in the art will appreciate that other embodiment of the lower damper may be configured in other shapes than illustrated in the depicted embodiment. Any configuration capable of being positioned between the front head 50 and the end plate 38 to relieve stress from the tie rods 52 and other hammer components, during a blank fire, may be used.

INDUSTRIAL APPLICABILITY

The disclosed lower damper may be used in a demolition hammer to prolong the life of the other hammer components (e.g. the side buffers) and prevent or reduce the likelihood of damage to other important hammer components (e.g. tie rods). During operation of the hammer, a blank fire may occur. A blank fire refers when the tool, during a power stroke, fails to engage the hard object to be broken and, instead, reaches the internal stops (i.e. engages the tool retaining pins).

During a blank fire, the hammer must absorb the forces intended to be transferred to the object being broken. Overstressing the tie rods, for example, can cause serious damage to the impact assembly, including the piston. The lower damper helps absorb some of the loads and reduce stress on other hammer components. The side buffers dampen some of that force by allowing the power cell to move axially downward relative to the housing. In the disclosed hammer, when the power cell moves downward sufficiently to close the gap between the power cell and lower damper, the lower damper is able to absorb some of the forces. As a result, the stress on the side buffers and on the tie rods is reduced, thus extending their service life.

What is claimed is:

1. A demolition hammer, comprising:

a housing having a distal end;

a power cell disposed in the housing;

an end plate attached to the distal end of the housing;

a damper disposed in the housing between the power cell and the end plate, wherein a buffer is spaced apart from the power cell by a gap, wherein the damper includes a generally rectangular first portion having a planar upper surface and a planar lower surface generally parallel to the upper surface and a generally circular second portion extending from the lower surface, wherein the first portion and the section portion define a through bore along a central axis; and a plurality of wear plates interposed between the housing and power cell, wherein the outer face of the damper supports the plurality of wear plates within the housing.

2. The demolition hammer according to claim 1 further comprising a plurality of wear plates interposed between the housing and power cell, wherein the damper supports the plurality of wear plates within the housing.

3. The demolition hammer according to claim 1 further comprising a plurality of wear plates interposed between the housing and power cell, wherein the outer face of the damper supports the plurality of wear plates within the housing.

4. The demolition hammer according to claim 1 wherein the inner face is positioned axially below the power cell.

5. The demolition hammer according to claim 4 further comprising a lower bushing for guiding the tool, wherein the lower bushing extends through the through bore and the tool extends through the housing.

6. The demolition hammer according to claim 1 further comprising a tool disposed in the housing and extending out of the housing through the through bore.

7. The demolition hammer according to claim 1 wherein the lower surface abuts the end plate.

* * * * *